United States Patent [19]

Glotin

[11] Patent Number: 4,553,599

[45] Date of Patent: Nov. 19, 1985

[54] CONTROL APPARATUS FOR OIL WELL PRODUCTION STRING CLOSING TOOL

[75] Inventor: Bernard J. Glotin, Saint Maur, France

[73] Assignee: Schlumberger Technology Corporation, New York, N.Y.

[21] Appl. No.: 395,447

[22] Filed: Jul. 6, 1982

[30] Foreign Application Priority Data

Jul. 8, 1981 [FR] France ..... 81 13810

[51] Int. Cl.[4] ..... E21B 34/14

[52] U.S. Cl. ..... 166/332; 166/316; 175/106

[58] Field of Search ..... 166/117.7, 183, 331, 166/332, 104, 330; 175/106, 101

[56] References Cited

U.S. PATENT DOCUMENTS

| | | | |
|---|---|---|---|
| Re. 24,304 | 4/1957 | Boynton . | |
| 2,002,386 | 5/1935 | Bannister | 175/106 |
| 2,167,019 | 7/1939 | Yost | 175/101 |
| 2,373,647 | 4/1945 | Boynton | 166/331 |
| 2,373,648 | 4/1945 | Boynton | 166/331 |
| 2,907,391 | 10/1959 | Kinley . | |
| 2,922,479 | 6/1960 | Kinley . | |
| 3,618,177 | 11/1971 | Wood | 166/117.1 |
| 3,831,677 | 8/1974 | Mullins | 166/128 |
| 4,015,662 | 4/1977 | Cochran | 166/104 |
| 4,159,643 | 7/1979 | Watkins | 166/250 |
| 4,209,070 | 6/1980 | Sudnishnikov | 173/110 |

*Primary Examiner*—Stephen J. Novosad
*Assistant Examiner*—John F. Letchford

[57] ABSTRACT

This invention relates to equipment which is installed in oil wells and more particularly to a tool control apparatus for a tool placed in the production string of a well.

This apparatus is lowered into the well at the end of a cable (116). It comprises a first mechanism (134-148-152-154) for transforming a longitudinal reciprocating movement into an alternating rotary movement, the longitudinal movement being obtained by pulling on the cable (116), and a second mechanism (156) forming part of the first, for transforming the alternating rotary movement into a one-directional rotary movement.

The invention also relates to an apparatus for closing the production string of a well, characterized in that it includes the closing apparatus or plug involved.

Application to oil well production tests.

9 Claims, 11 Drawing Figures

CONTROL APPARATUS FOR OIL WELL PRODUCTION STRING CLOSING TOOL

This invention relates to equipment which is installed in oil wells or in geothermal wells. More precisely, the invention relates to an apparatus for controlling equipment placed in a well, the control taking place by means of a cable lowered into the well from the surface. The invention also relates to an apparatus for closing the production string of a well and for measuring the variations in pressure resulting from said closure.

The hydrocarbons contained in an underground stratum are brought to the surface through production tubing, called a production string, placed in the centre of the borehole. The production string is generally equipped at predetermined locations with landing nipples in which can be installed various types of equipment. This equipment is lowered at the end of a cable winding on the drum of a winch at the surface. The cable is thus used to install equipment in a landing nipple, but it can also be used to control equipment already in place. For example, a valve can be installed at a given location of the production string and the cable can be used to operate this valve.

Before putting the well into production, different tests are carried out, consisting in particular of pressure, temperature and flow measurements. One of the main tests making it possible to determine the production capacity of the well consists in stopping the production by means of a valve and recording the variations in pressure resulting from the closure of the well. In most cases, the closing of the well takes place from the surface. However, the rise in the pressure of the well fluids following the closing of the well can be concealed by other phenomena such as the compressibility of the fluid in the production string. It is consequently very advantageous to be able to close the production string from the immediate vicinity of the underground production zone so as to take into account only this zone. The control of this valve generally takes place by means of a tool which is lowered into the well at the end of a cable from the surface. However, in order for the pressure measurements to be meaningful, the flow of fluids in the production string prior to the closing of the valve must not have been disturbed. Furthermore, it is important to be able to carry out measurements immediately after closing the valve.

There are prior-art tools for closing the production string of a well and for pressure measurement. For example, such tools are described in French Pat. Nos. 2 422 812 and 2 423 627 as well as in U.S. Pat. No. 4,159,643. All these devices are made up of two parts: a valve installed removably in the production string and an apparatus for actuating this valve. This control apparatus is lowered into the well at the end of a cable and is fixed on a part of the valve to close the orifices through which flows the fluid produced by the well. A pressure gauge is generally mounted on top of a central canal going through the control apparatus and transmitting the well pressure to the pressure gauge. In this type of equipment, the closing of the valve takes place immediately after the lowering of the control apparatus, whereas it would be necessary to wait a certain time for the fluid flowing in the production string to become stabilized.

It is an object of the present invention to provide a control apparatus for a tool placed in a well, for example a valve, and more particularly an apparatus for controlling a production string closing tool. This apparatus makes it possible to close the valve practically instantaneously at a time which may be much later than the lowering of the valve and its control apparatus into the well. Furthermore, the inadvertent closing of the valve is made very improbable.

It is also an object of the invention to provide an apparatus allowing the measurement of pressure variations resulting from the closing of the production string.

More precisely, the invention provides a control apparatus for a tool placed in the production string of a well, said apparatus being capable of being lowered into the well at the end of a cable, characterized in that it comprises a first mechanism for transforming a longitudinal reciprocating movement into an alternating rotary movement, the longitudinal movement being obtained by pulling on said cable, and a second mechanism, connected with the first, for transforming said alternating rotary movement into a one-directional rotary movement.

The invention also provides an apparatus for closing the production string of a well, comprising a valve attached in a leaktight manner in the string and having a longitudinal central passage allowing the flow of fluids and a lateral passage which can be closed by a plug, characterized in that it includes a control apparatus for the plug as described in the preceding paragraph.

The invention will be better understood from the following description of an embodiment given by way of nonlimitative example with reference to the appended drawings in which.

Figure 5:
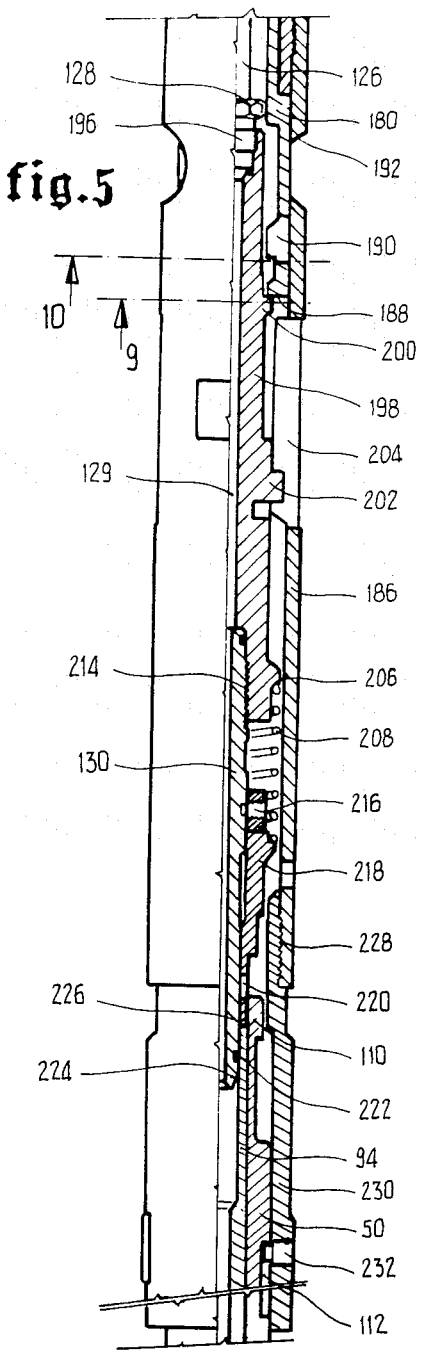
Figure 8:
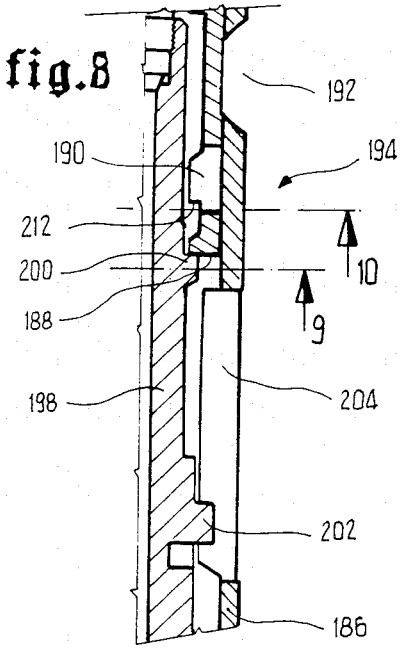
FIG. 8 is an enlarged sectional view of part of FIG. 5.
Figure 10:
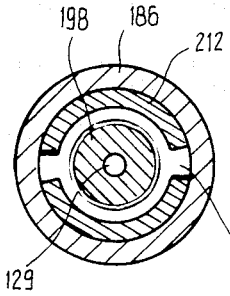
Figure 9:
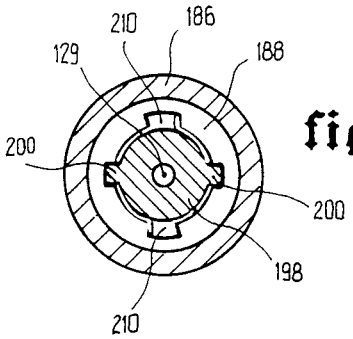

FIGS. 9 and 10 represent cross sections as seen from the arrows 9 and 10 of FIGS. 5 and 8.

Figure 1:
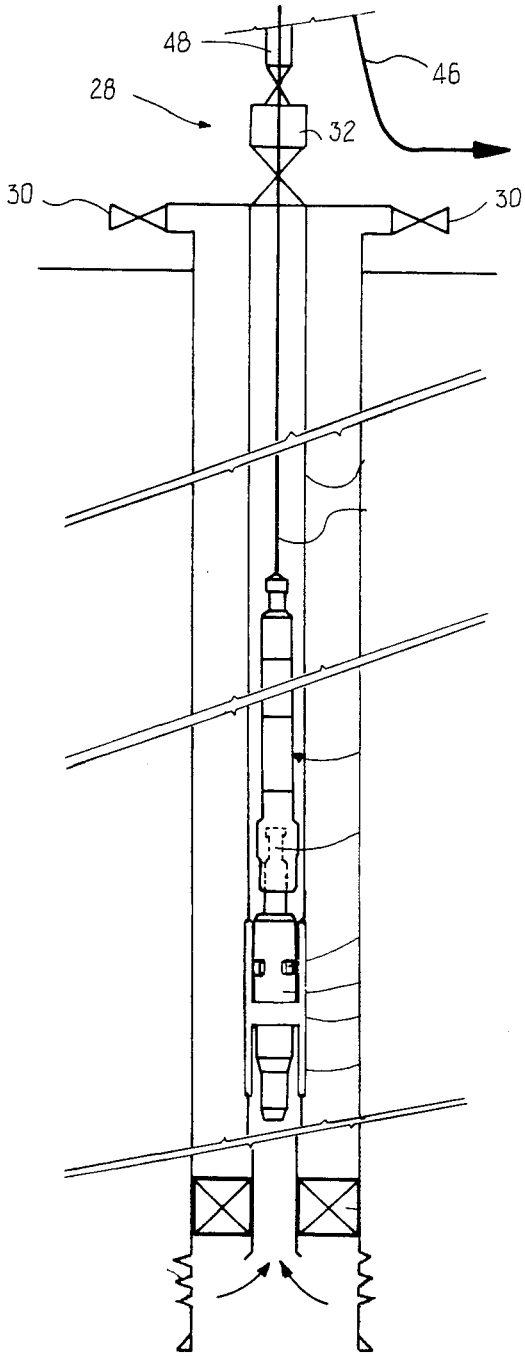
FIG. 1 represents schematically a general view of the control apparatus and of the valve installed in the production string of a well.
Figure 2A:
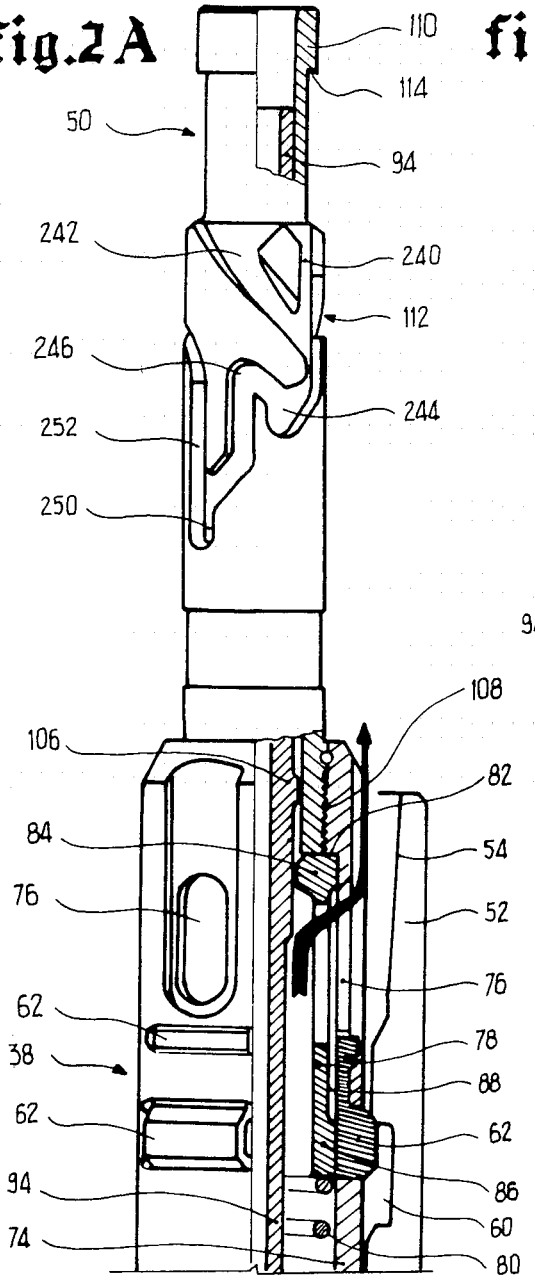
FIGS. 2A and 2B represent, in partial section, the valve in the open position.
Figure 2B:
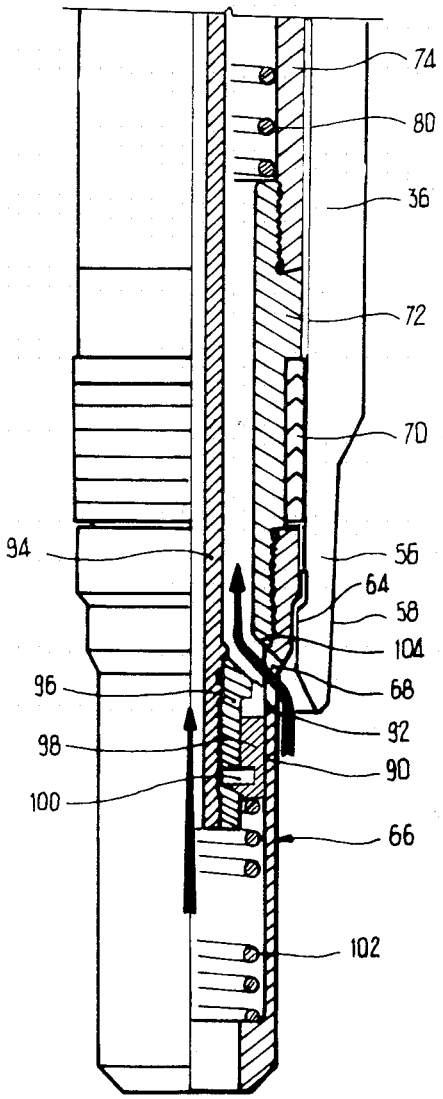
Figure 3:
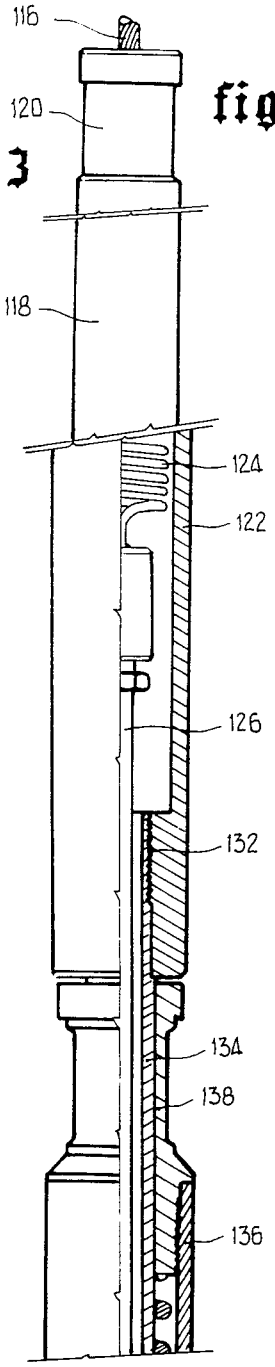
FIGS. 3, 4 and 5 represent three successive parts, in partial section, of the control apparatus of the valve, the lower end of FIG. 3 being superposed on the upper end of FIG. 4, and the lower end of FIG. 4 being superposed on the upper end of FIG. 5.
Figure 4:
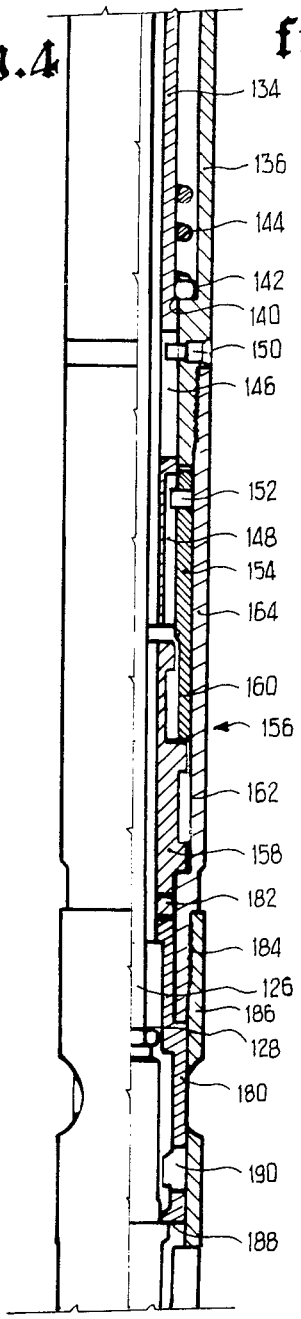

In FIG. 1 has been represented a well drilled down to an underground formation 20 producing a fluid which can be liquid or gas or a mixture of both. The well includes a casing 22 whose lower end has been pierced with perforations 24 so as to allow the flow of fluids from the formation into the well. A production string 26 has been placed in the center of the well and extends substantially from the bottom to the surface. The casing 22 and the production string 26 terminate on the surface in a wellhead represented schematically by 28. It includes a main valve 32 and several lateral valves 30. A packing 34, commonly referred to as a "packer", is placed in a leaktight manner at the bottom of the production string, in the annulus between the casing 22 and the production string 26. The valve 38, represented in detail in FIGS. 2A and 2B, is fixed in a sealed manner in a landing nipple 36 not far from the producing zone 20 by means of keys 40 and packings 42. The valve control apparatus 44 has been lowered at the end of a cable 46. This cable is wound on the surface over the drum of a winch (not shown). The cable goes through a sealing device 48 (gland) fixed on the wellhead 28. The valve control apparatus is placed by means of the cable 46 on the head 50 located on top of the valve 38.

The valve 38 is shown in FIGS. 2A and 2B whereas the control apparatus 44 is shown in the following figures.

The cable 46 can be a wire rope or an electric cable. An electric cable is used when it is desired to transmit electric signals, representing measurements, for example, from the well-closing tool to the surface and vice versa.

In FIGS. 2A and 2B, the landing nipple 36 is screwed between the two tubes of the production string at its upper end 52 by the thread 54 and at its lower end 56 by the thread 58. This nipple has recesses 60 into which fit three keys 62 of the valve. The nipple terminates at its lower end in a stop 64. The valve 38 is fixed in the nipple 36 by means of the stop 64 which prevents its downward movement and by means of the keys 62 fitted into the recess 60. The valve body 66 has approximately a hollow cylindrical form. The valve body is pierced at its lower end with one or more orifices 68. The diameter of the valve has been reduced at this location so as to obtain a larger passage section for the fluid flowing through the orifices. Over the orifices, packings 70, held on a support 72, provide leaktightness between the landing nipple 36 and the valve body. A part 74, screwed onto the upper part of the support 72, has openings allowing the passage of the keys 62. This part also has several openings 76 for the passage of the fluid. A mobile socket 78 is maintained by a spring 80 against the internal upper part 82 of the valve body. This mobile socket has, at its upper end, a boss 84 and, at its lower end, a bulge 86. When the mobile socket 78 is in the upper position, as shown in FIG. 2A, the bulge 86 pushes the keys 62 outward into the recess 60 of the landing nipple. On the other hand, when the mobile socket moves downward, the keys 62 are no longer pushed by the bulge 86 but come into contact on the part 88. They are thus free to retract to come out of the recess 60.

The orifices 68 can be closed by a valve element 90 made up of a seat 92 in flexible material (plastic) maintained on a hollow rod 94 by means of two parts 96 and 98 and the screw 100. A spring 102 tends to push the valve element 90 so that the seat 92 bears on the part 104 of the valve body to close the orifices 68. The hollow rod 94 goes completely through the valve. It includes a crown 106 which can come into contact with the boss 84 of the mobile socket 78. When the mobile rod 94 is pushed downward, the valve is first opened by the exposure of the orifices 68 and then, the crown 106 coming into contact with the boss 84, the mobile socket 78 is pushed downward thereby releasing the valve.

At the upper end 108 of the valve body is screwed a fishing head 50. It includes at its upper end a flange 110 and in its middle part a set of slots 112 in which a tenon can move.

The valve is installed in the landing nipple by means of a setting tool. This setting tool includes a central part which keeps the hollow rod 94 in a sufficiently low position so that the orifices 68 are uncovered and so that the keys 62 are in the retracted position. The valve is fixed to the setting tool by a shear pin which comes up against the lower part 114 of the flange 110. The valve is lowered into the production string with the setting tool until it is stopped by the stop 64 of the landing nipple. By means of a bumper sub fixed over the setting tool, one shears a pin which held the central part of the setting tool in the lower position. This part, as well as the hollow rod 94, pushed by the spring 102, rises so as to anchor the keys 62 in the recess 60 and close the valve by closing off the orifices 68. By pulling on the cable from the surface, it is verified that the valve is anchored. Then, pulling more forcefully on the cable, one shears the pin held at the lower end 114 of the flange 110 to free the setting tool and bring it back up to the surface. It is to be noted that when the valve is left installed in the production string, it is kept in the closed position by the spring 102. However, the fluids produced by the well can flow through the bottom of the hollow rod 94.

Figure 6:
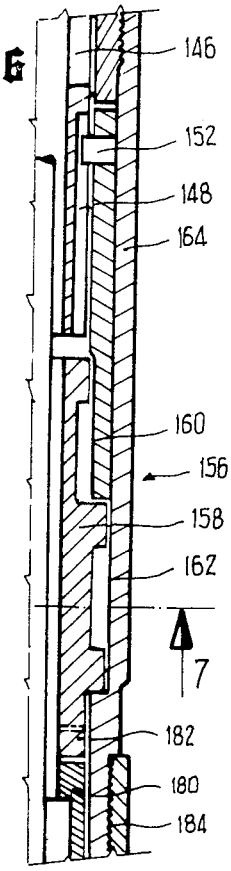
FIG. 6 represents a an enlarged sectional view of part of FIG. 4.
Figure 7:
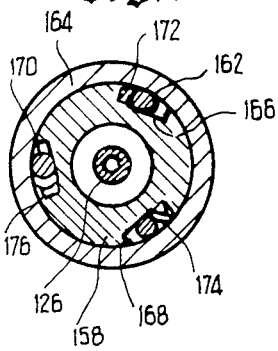
FIG. 7 represents a cross section of the clutch mechanism from the arrow 7 of FIG. 6.

The control mechanism is represented in FIGS. 3 to 10. It is combined with means for transmitting the pressure of the well to a pressure transducer. The assembly is attached to a cable 116 which rises up to the surface where it is wound over the drum of a winch. In the example described, this cable is an electric cable making it possible to send to the surface the pressure measurements carried out by means of a gauge 118 connected to the cable by means of an electric connection plug 120. The gauge 118 can be any gauge presently available on the market, for example the gauge of the type 2813 marketed by the American company Hewlett-Packard. The pressure transducer is fixed at the upper part of a jacket 122. A tube 124 wound in spiral form transmits the pressure of the well to the measurement gauge 118. The lower end of the tube 124 is screwed onto a straight tube 126 going entirely through the valve control mechanism. Its lower end 128 (FIGS. 4 or 5) is screwed by means of sealed connection means 196 to the actuator 198 of the control apparatus, the internal part of which forms a channel 129. The lower end of the jacket 122 (FIG. 3) is screwed by means of threads 132 to a sliding hollow rod 134. This rod 134 slides within a case 136 terminated at its upper part by a head 138. The sliding rod 134 comprises a stop 140 against which is held a ring 142 by means of a return spring 144. It will be noted that, by pulling the cable 116, the sliding rod 134 and the ring 142 rise in relation to the case 136 against the return force exerted by a spring 144. This spring is the equivalent of a weight of 140 kg when it is completely compressed and applied on the head of the control apparatus. The lower end of the sliding rod 134 has a groove 146 parallel to the longitudinal axis of the control apparatus and another groove 148 of helical form inclined by about ten degrees in relation to the longitudinal axis of the control apparatus. A tenon 150 fixed in the case 136 moves in the groove 146. It prevents the rotation of the sliding rod 134 when it moves vertically in a to-and-fro movement. Inside the groove 148 moves a tenon 152 fixed to a shaft driving a clutch mechanism 156. This mechanism, represented in greater detail in FIGS. 6 and 7, is a roller-type clutch mechanism. It is contained in a jacket 164. This mechanism comprises a drive shaft 154 and a driven shaft 158 coupled by a first group of three rollers 160. The drive shaft 154 describes an alternating rotary movement whereas the driven shaft 158 describes a one-directional rotary movement. The rollers 160 couple the driven and drive shafts only when the drive shaft turns in a given direction of rotation. A second group of three rollers 162 which couple the driven shaft to the jacket 164 (which is partly fixed), constitute opposing rollers which prevent the rotation of the driven shaft 158 in the opposite direction.

FIG. 7, which represents a section perpendicular to the longitudinal axis, shows the clutch mechanism for the opposing rollers 162. There are three of these rollers and they are held in recesses 166, 168 and 170 made in the driven shaft 158. They are loaded by springs 172, 174 and 176. The driven shaft 158 is traversed by the tube 126. There are also three rollers 160 which are in recesses made in the driven shaft 158. They are also held by springs but these springs are placed diametrically in the opposite direction (180°) in relation to the springs 172, 174 and 176. Thus, in FIG. 7, it is understood that the action of the rollers 162 allows the clockwise rotation of the shaft 158, whereas these rollers prevent rotation in the opposite direction by securing the driven shaft 158 to the jacket 164. For a given rotation direction of the drive shaft, the rollers 160 are pinched in the their recess and thus connect the driven and drive shafts. On the other hand, in the other rotation direction, the rollers are free and the drive and driven shafts are disconnected.

The driven shaft 158 is coupled to a rotating part 180 by connection means 182 which can be mortises for example.

The lower end of the case 164 is screwed by means of threads 184 to the upper part of a jacket 186. Inside this jacket rotates the part 180 terminating in a bearing surface 188. It also includes grooves 190. Openings 192 have been made in the jacket 186 so as to have access to the rotating part 180. This latter part has striations on its surface opposite the openings 192 so as to constitute a knurled button. Furthermore, it has markings making it possible to determine the position of the rotating part 180 in relation to the jacket 186. The end of the rotating part 180 is an element of the actuating mechanism 194 shown in greater detail in FIGS. 8, 9 and 10. By means of a coupling 196, the lower end 128 of the central tube 126 is screwed onto the upper end of an actuator 198. The central part of the actuator is grooved so as to form a channel 129. This actuator has a projecting part 200 forming lugs which bear against the surface 188 of the rotating part. It also includes a tenon 202 which moves in a groove 204 of the jacket 186. The actuator can consequently not rotate and can move only parallel to the longitudinal axis. Its lower end forms a stop 206 against which bears a spring 208.

The actuator 198 has two diametrically opposite lugs 200 (FIG. 9). These lugs, as shown in FIG. 8, bear on the surface 188 of the rotating part 180. This latter part has two hollows 210 through which the lugs 200 can pass. Thus, when the part 180 turns by 90 degrees in relation to its position shown in FIG. 9, the lugs 200 are opposite the hollows 210. The actuator 198 then moves upward, pushed by the spring 208. The actuator moves until the lugs come up against a bearing surface 212 (FIG. 10). The actuator thus goes from a first position to a second position. The rotating part also includes two hollows or slots 190 diametrically opposite and located at 90 degrees in relation to the hollows 210. Thus, comparing FIGS. 9 and 10, when the lugs 200 go through the hollows 210 to come up against the bearing surface 212, they are at 90 degrees in relation to the slots 190. If the part 180 continues to turn, the slots 190 will come opposite the lugs 200 of the actuator 198. At this point, the actuator 198 will again translate upward to go from a second position to a third position.

The lower part of the actuator 198 is screwed by means of threads 214 to a hydraulic connector 130 whose internal part is completely hollowed and forms a longitudinal central channel extending the channel 129. The connector 130 has a safety pin 216, forming a stop, on which bears a socket 218 which can slide on the external surface of the hydraulic connector 130. The socket 218 has openings 220. A O-ring seal 222 is placed in a slot made in the surface of the lower end 224 of the hydraulic connector 130. The end 224 of the connector fits in a leaktight manner, thanks to the seal 222, into the internal part of the hollow rod 94 of the valve. The end of the hollow rod of the valve comes up against the lower end 226 of the socket 218.

To the lower part of the jacket 186 is fixed, by means of threads 228, a cylindrical part 230 having a tenon 232. It moves in the slots 112 of the valve head 50.

Once the valve 38 is installed in the production string and the setting tool raised to the surface, the control apparatus 44 is lowered from the surface by means of the electric cable 116. The valve is in the closed position and the socket 218 is loaded by the spring 208 so that the lower end of the socket covers the seal 222 to protect it. The cylindrical part 230 (FIG. 5) of the control apparatus comes over the valve head. The tenon 232 goes into one of the slots 240 or 242 (FIG. 2A) of the system of slots 112 of the valve head. The tenon 232 then fits into the part 244 of the system of slots 112. Simultaneously, the end 224 of the hydraulic connector has been fitted in a sealed manner inside the hollow rod 94. Thus, the socket 218 comes up against the stop on the safety pin 216. The hollow rod 94 is then pushed downward, thereby opening the valve by clearing the orifices 68. The cable is then pulled from the surface so that the tenon 232 goes from the part 244 of the slot system to the recess 246. For this position, the valve is open enabling the fluid from the well to flow through the orifices 68 into the channel between the hollow rod 94 and the valve body 74 and through the openings 76 as shown schematically by the arrows in FIGS. 2A and 2B. The well pressure can be measured by the pressure gauge 118 since the fluids go through the channel constituted by the inside of the hollow rod 94, through the inside of the hydraulic connector 130, through the channel 129 and through the tube 126.

To close the valve, the cable is pulled several times successively from the surface. When the cable is pulled, the sliding rod 134 rises and compresses the spring 144. The result is that the drive shaft 154 of the clutch mechanism turns by about 10 degrees. This angle depends on the inclination of the groove 148 and on the longitudinal movement of the sliding rod 134. The driven shaft 158 and the rotating part 180 also turn by the same angle. When the tension on the cable is released, the sliding rod 134 comes back to its initial position under the action of the spring 144. On the other hand, the driven shaft 158 and the rotating part 180 do not turn in the opposite direction. If, at the outset, the hollows 210 of the rotating part 180 were positioned at about 90 degrees from the tenons 200 (as shown in FIG. 9), it is understood that it is necessary to pull about nine times on the cable 116 so that the tenons 200 are opposite the hollows 210. When this occurs, the hydraulic connector 130 and the actuator 198 rise by a distance corresponding to that between the bearing surfaces 188 and 212, going from a first to a second position. This has the effect of closing the valve 38. It is noted that the closure of the valve is practically instantaneous. Furthermore, the pressure variations resulting from the closure can be recorded immediately. It will be similarly noted that the flow of fluids before the closure of the valve was not disturbed since the fluid could flow freely through the orifices 68. For this second position of the actuator, the O-ring seal 222 of the end of the hydraulic connector is again under the opening 220 in the socket 218. When it is desired to stop the measurements and to raise the valve control apparatus to the surface, the pressures are first balanced by pulling several times successively on the cable 116. The hollows 210 being located at 90 degrees from the slot 190, it is realized that it is again necessary to pull about nine times on the cable so that the tenons 200 can go through the slots 190. When this occurs, the actuator 198 and the hydraulic connector 130 rise. The O-ring seal 222 then goes over the openings 220 of the socket 218, thereby balancing the pressures. The well pressure had a tendency to push the control apparatus upwards. With the balancing of the pressures, this thrust no longer exists. By releasing the tension on the cable 116, the control apparatus is lowered by its own weight. The tenon 232 then goes from the recess 246 of the slot system 212 of the valve head to the position 250. By pulling on the cable from the surface, the tenon 232 then goes through the slot 252 and the control apparatus is disconnected from the valve and can be raised to the surface.

If for any reason, the control apparatus does not descend, i.e. if the tenon 232 does not go from the position 246 to the position 250 by the weight of the control apparatus alone, the cable 116 is pulled so as to break it at its weak point. Then a fishing tool is lowered from the surface with a bumper sub. By beating downward, the pin 216 is broken and by bearing on the control apparatus it is possible to make the tenon 232 go from the position 246 to the position 240 of the valve head. The control apparatus is then raised to the surface.

The valve control apparatus just described has several advantages, among which may be mentioned its small length resulting from the fact that it is necessary to pull several times on the cable from the surface to operate the valve. In fact, to obtain the same effect by pulling only once from the surface the travel of the sliding rod 134 would have to be longer. The need to pull several times on the cable also prevents inadvertent operation of the valve. It may also be noted that the tension on the cable does not have to be maintained outside of the periods during which the valve is being operated. Actuation also takes place instantaneously. As regards pressure measurements using the valve control apparatus, it will be noted that pressure variations can be recorded before and after the closing of the valve without interruption.

The control apparatus has been described in connection with an apparatus for measuring pressure variations resulting from the closing of the production string of a well. This apparatus can however be applied to other tools which can be controlled by backing off of a part in relation to another (backing off of actuator 198 in relation to the fixed elements). The pressure measurement tool has been described with a pressure gauge located at the top of the tool and used with an electric cable for the transmission of data to the surface. It is obvious that the pressure gauge could be placed at another location of the tool and that this gauge could include memories for recording the data in the well. The cable 116 could then be a simple steel cable. The pressure gauge could also be a transducer for measuring another parameter such as the temperature.

I claim:

1. Control apparatus for a tool placed in the production string of a well, said apparatus being capable of being lowered into the well at the end of a cable, comprising:

a first mechanism for transforming a longitudinal reciprocating movement into an alternating rotary movement, the longitudinal reciprocating movement being obtained by pulling on and releasing said cable; and a second mechanism made up of a roller-type clutch connected with the first mechanism for transforming said alternating rotary movement into a one-directional rotary movement;

said first mechanism comprising a rod sliding along the longitudinal axis of the apparatus under the action of pulling forces exerted on the cable, said sliding rod having a groove of helical form;

said second mechanism comprising a drive shaft equipped with a tenon engaging in said groove so that the drive shaft describes an alternating rotary movement when said rod moves longitudinally in a to-and-fro movement, and driven shaft having slots and rollers placed in said slots, said shafts and rollers forming said clutch so that said driven shaft is imparted only a one-directional rotary movement;

said driven shaft comprising a first bearing surface equipped with a first hollow; and said apparatus including an actuator mobile longitudinally between a first and a second postion, connected with a element of the tool to be controlled and having a part kept against said bearing surface, said part engaging in said hollow for a given angular position of said driven shaft in relation to said actuator, thereby causing said actuator to go from the first to the second position.

2. The apparatus of claim 1, wherein said driven shaft includes a second bearing surface spaced longitudinally in relation to the first bearing surface and equipped with at least a second hollow offset angularly in relation to the first hollow, said part of the actuator in contact with the first bearing surface being capable of engaging in the second hollow for another given angular position of the driven shaft in relation to the actuator, thereby causing said actuator to go from the second longitudinal position to a third position.

3. The apparatus of claim 2, wherein the angle of inclination of said helical groove in relation to the longitudinal axis of the tool and the angular offsets between each of said hollows and said actuator are such that the cable must be pulled several times to go from said first position to said second position and from said second position to said third position.

4. The apparatus of any of claims 1, 2 or 3 wherein said element of the tool to be controlled is the plug of a valve.

5. Device for closing the production string of a well comprising a valve fixed in the string in a sealed manner, having a central longitudinal passage allowing the flow of fluids and a side passage which can be closed by a plug, said device including a plug control apparatus as described in claims 1, 2 or 3.

6. The device of claim 5, wherein said actuator includes, at its end, a hydraulic connector capable of being connected in a sealed manner in said central passage of said valve.

7. The device of claim 6, wherein said central passage is made up of a cylindrical sleeve one end of which carries a valve element for closing and opening said side passage, the other end coming up against said actuator.

8. The device of claim 7 further comprising a spring pushing said valve element toward the valve closing position, the opening being achieved by the pushing of said actuator on said cylindrical sleeve.

9. The device of claim 5, used for measuring pressure variations resulting from the closing of the production string, said device containing pressure measurment means and sealed means for conveying the pressure from said central passage to said measurement means.

* * * * *